US006720934B1

(12) United States Patent
Price et al.

(10) Patent No.: US 6,720,934 B1
(45) Date of Patent: Apr. 13, 2004

(54) PARALLEL FED COLLINEAR DIPOLE ARRAY ANTENNA

(75) Inventors: Edward G. Price, Sandy, UT (US); Richard F. Gordon, Salt Lake City, UT (US)

(73) Assignee: Skywire Broadband, Inc., Salt Lake City, UT (US)

( * ) Notice: Subject to any disclaimer, the term of this patent is extended or adjusted under 35 U.S.C. 154(b) by 0 days.

(21) Appl. No.: 10/056,974

(22) Filed: Jan. 25, 2002

Related U.S. Application Data

(60) Provisional application No. 60/265,172, filed on Jan. 25, 2001.

(51) Int. Cl.[7] ..... H01Q 9/16

(52) U.S. Cl. ..... 343/801; 343/792; 343/800

(58) Field of Search ..... 343/790, 791, 343/792, 800, 801, 813; H01Q 9/16

(56) References Cited

U.S. PATENT DOCUMENTS 4,071,846 A 1/1978 Oltman, Jr.
4,083,051 A * 4/1978 Woodward ..... 343/797
4,087,823 A * 5/1978 Faigen et al. ..... 343/791
4,326,203 A 4/1982 Kaloi
4,369,449 A 1/1983 MacDougall
4,410,893 A * 10/1983 Griffee ..... 343/792
4,943,811 A 7/1990 Alden et al.
5,293,175 A 3/1994 Hemmie et al.
5,469,181 A 11/1995 Yarsunas
5,568,161 A 10/1996 Fulmer, Sr.
5,867,131 A 2/1999 Camp, Jr. et al.
6,057,804 A 5/2000 Kaegebein
6,531,985 B1 * 3/2003 Jones et al. ..... 343/702

* cited by examiner

*Primary Examiner*—Tho Phan
(74) *Attorney, Agent, or Firm*—Thorpe North & Western, LLP

(57) ABSTRACT

A parallel fed colinear dipole array antenna for broadcasting and receiving a signal of a selected wavelength. The antenna comprises a plurality of elongate dipole antennas attached end-to-end in a linear array. A power divider divides and transmits a signal in parallel to each of the dipole antennas. The linear spacing of the dipoles is correlated with the dimensions of the dipoles and the selected wavelength, such that the signals of the dipole antennas interfere with each other when broadcast, so as to focus signals which propagate substantially perpendicularly to the linear array, and to diminish other signals.

22 Claims, 2 Drawing Sheets

PARALLEL FED COLLINEAR DIPOLE ARRAY ANTENNA

The present application claims priority from United States Provisional Patent Application Ser. No. 60/265,172, filed on Jan. 25, 2001, and entitled PARALLEL FED COLLINEAR DIPOLE ARRAY ANTENNA.

BACKGROUND OF THE INVENTION

1. The Field of the Invention

The present invention relates generally to directional antennas. More particularly, the present invention relates to an antenna comprising a linear array of parallel fed dipoles.

2. The Background Art

With recent advances in computer and communications technology and their associated work and lifestyle changes, rapid and accurate telecommunications and data transmission have become increasingly important. One very important method of transmitting data has been through direct radio communication using a transmitter and a receiver. Both the transmitter and the receiver use an antenna to transmit or receive a signal. Accordingly, there are many forms of antennas which have been devised to increase the power and directivity of signal transmission and reception. For example, microwave dishes are used in the communications industry to carry telephone messages and other information over long ranges. Internet connections have also been provided using directional broadband equipment which broadcasts data to subscribers.

With the advent of computer networking, it has become desirable to send directional data over relatively short distances with low power. In the United States, for example, certain broadcast frequency ranges are open to unlicensed use, so long as the broadcast power is kept below a certain range. For example broadcasting in the range of 2400 MHz to 2500 MHz requires no FCC license so long as the broadcast power is below 1 watt. Unfortunately, many known directional antennas such as microwave and satellite antennas are much too expensive to use for short range, low power signal transmissions. Other types of straight or looped antennas can be used for these short range transmissions but many of these configurations suffer from interference and static when they are transmitting such a low power signal. Moreover, if the low power signal is not properly directed, its range, and hence the usefulness of the antenna, can be greatly diminished because a substantial portion of the broadcast energy is wasted, rather than being sent where it is needed.

SUMMARY OF THE INVENTION

It has been recognized that it would be advantageous to have a low power directional antenna which is balanced omni-directionally, with high directivity and broad bandwidth, and that is also simple in design.

The present invention advantageously provides a parallel fed colinear dipole array antenna for broadcasting and receiving a signal of a selected wavelength. The antenna comprises a plurality of elongate dipole antennas attached end-to-end in a linear array. A power divider divides and transmits an in-phase signal in parallel to each of the dipole antennas. The linear spacing of the dipoles is selected such that the signals of the dipole antennas interfere with each other so as to focus signals which propagate substantially perpendicularly to the linear array, and to diminish other signals.

In accordance with one aspect of the present invention, the plurality of dipole antennas are interconnected by a plurality of dipole spacers comprising a dielectric material such as Delrin, ABS, or styrene. More particularly, the length of the spacers may be selected such that the ends of the dipoles are separated by an effective distance equal to about one sixth of the selected wavelength.

In accordance with another aspect of the present invention, the length of the dipoles is selected to match the characteristic impedance of the dipoles with the impedance of the transmission. lines. The antenna may more particularly comprise an array of four dipoles.

In accordance with another aspect of the present invention, each of the plurality of elongate dipole antennas may comprise first and second colinear electrically conductive tubes, such as thin-walled copper tubing. A gap spacer comprising dielectric material may be disposed between the first and second colinear tubes.

In accordance with another aspect of the present invention, the power divider may comprise a Wilkinson divider having an input connection for receiving a signal, a plurality of conductive pathways interconnected to the input connection, each conductive pathway having an effective length equal to about one half the selected wavelength. A plurality of drive lines may be associated with the power divider, each line connecting one of the plurality of dipole antennas to one of the conductive pathways of the power divider. The drive lines may have a length equal to an integer times about one half of the selected wavelength.

Additional features and advantages of the invention will be set forth in the detailed description which follows, taken in conjunction with the accompanying drawings, which together illustrate by way of example, the features of the invention.

DETAILED DESCRIPTION

Figure 1:
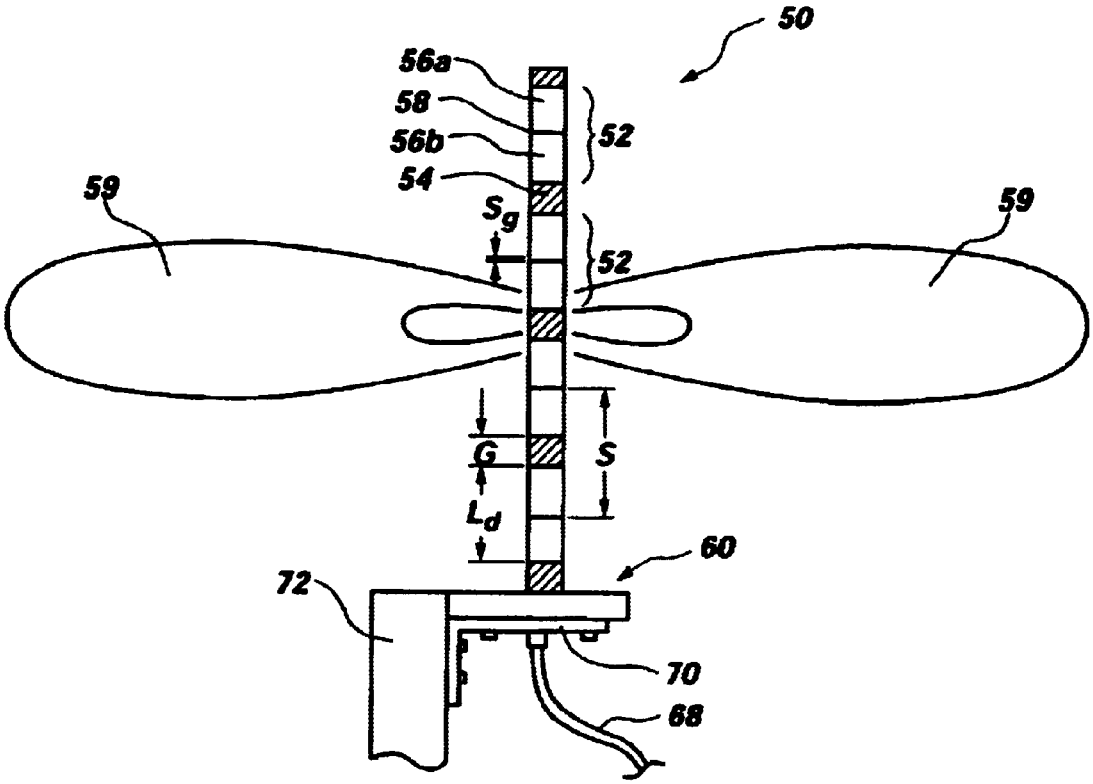
FIG. 1 is a side view of a colinear array of four dipoles in accordance with the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Figure 4:
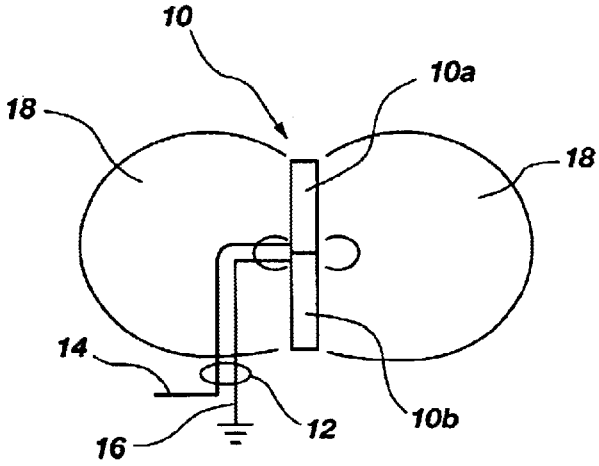
FIG. 4 (PRIOR ART)
FIG. 4 is a side view of a typical prior art dipole antenna with its associated broadcast pattern.

Dipole antennas have been known and used for many years. As shown in FIG. 4, a conventional dipole antenna 10 comprises two colinear but oppositely oriented elongate conducting elements 10*a* and 10*b* which are electrically insulated from each other, and are connected to opposing leads of a transmission line 12. A signal to be broadcast from the antenna is sent down one conductor 14 of the transmission line, with the other conductor 16 being grounded, as shown. This configuration causes the signal to be broadcast in a toroid or donut shaped broadcast pattern, represented by the figure-8 shaped area 18, which represents a cross-section of the signal pattern.

Figure 5:
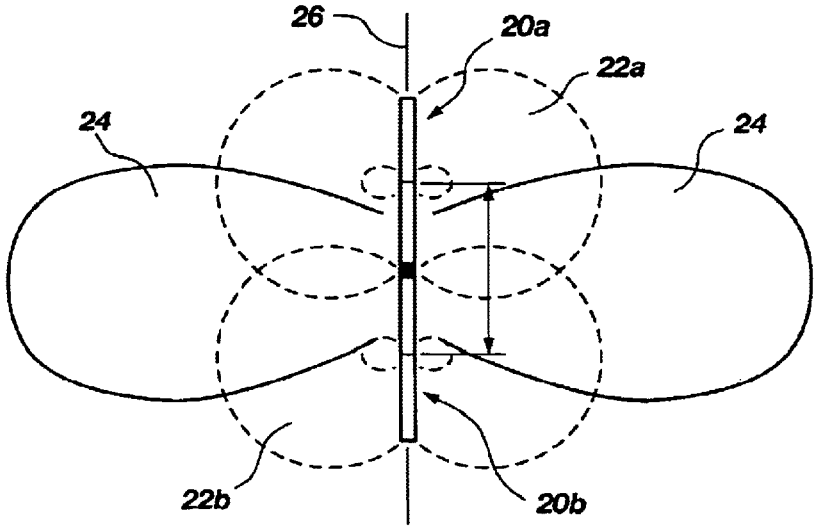
FIG. 5 is a side view of a colinear array of two dipole antennas, showing its associated broadcast pattern.

Viewing FIG. 5, when two or more dipoles 20*a*, 20*b*, are attached end to end, their characteristic broadcast patterns 22*a*, 22*b*, shown in dashed lines, interfere with each other. If the dipoles are in phase, and driven in parallel, and the linear spacing Y of the dipoles is properly selected relative to the wavelength of the signal ($\lambda_0$), interference between nearby colinear dipoles can be manipulated to diminish the signal in a direction parallel to the axis 26 of the array, and focus the signal in a direction perpendicular thereto. In particular, the configuration of FIG. 5 can produce a broadcast pattern 24 which has the characteristic donut or toroid shape of a conventional dipole, but is flatter and more spread out in a plane that is perpendicular to the axis 26 of the dipole array. This effect reduces the amount of broadcast energy which propagates parallel to the axis of the dipole array, and increases the amount of broadcast energy which propagates in a plane perpendicular to the axis of the dipole array. It has been found that increasing the number of dipoles properly connected end-to-end in this manner further enhances the effect, such that the larger the number of connected dipoles, the flatter the broadcast pattern.

Those skilled in the art will recognize that wavelength is the inverse of frequency. In the present case, using a formula well known to those skilled in the art, the signal wavelength $\lambda_0$ (in inches) can be expressed as $\lambda_0=11808/F_0$, where $F_0$ is the frequency of the signal in megahertz (MHz).

Figure 2:
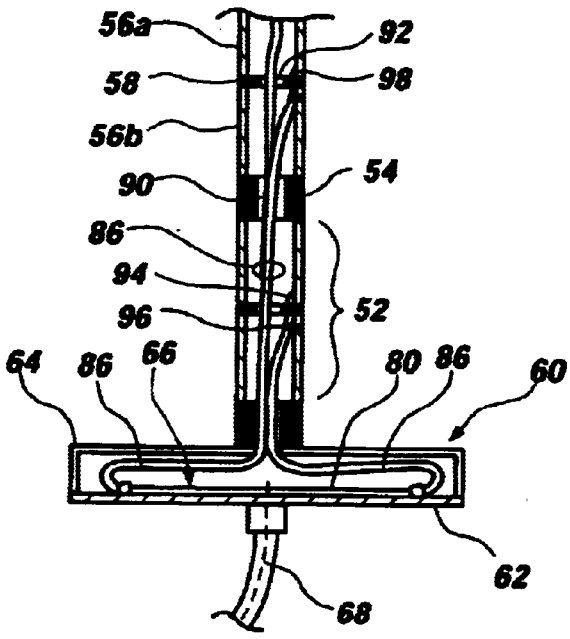
FIG. 2 is a cross-sectional view of the base and a portion of the antenna shaft of the antenna of FIG. 1.

As illustrated in FIG. 1 and FIG. 2, a colinear dipole array antenna 50 in accordance with the present invention is shown. The antenna 50 comprises a plurality of dipole segments 52, interconnected by dipole spacers 54. Each dipole segment is comprised of a pair of electrically conductive tubes 56*a* and 56*b*, which are interconnected by a gap spacer 58. The dipole spacers and gap spacers are preferably dielectric material, such as Delrin, ABS, or styrene. Other suitable dielectric materials may also be used. In an embodiment of the antenna depicted in FIG. 1, the gap spacers provide a gap $s_g$ between adjacent portions of each dipole of about 0.065 inches (i.e. $s_g$=0.065")

In accordance with the principles of operation discussed above, the dipole segments 52 have a linear spacing S therebetween which is selected such that the signals of the plurality of dipole antennas interfere with each other, and focus signals which propagate substantially perpendicularly to the linear array, and to 10 diminish other signals, as shown by the signal pattern 59. In the embodiment of FIG. 1, the dimension S is about 0.6 times the signal wavelength (i.e. $S=0.60\lambda_0$). To create this structure, the dipole spacers 54 separate the ends of adjacent dipole antennas by an effective distance G which is equal to about one sixth of the selected wavelength (i.e. $G=0.165\lambda_0$). In the embodiment of FIG. 1, the dipole array comprises four dipoles connected end-to-end, which is one preferred configuration for producing a signal pattern which is broad and flattened, but not too broad.

The dimensions shown in the figures are given in terms of the wavelength of the signals because the illustrated embodiment may be configured to broadcast and receive signals in a variety of frequency ranges. For example, the inventors have configured the the antenna for use in the unlicensed 2400 MHz to 2500 MHz range, at 50 ohms, with a power of about 30 mW. Current FCC regulations allow broadcasts with a power of up to 1.0 watt in this unlicensed frequency range. However, while the antenna is very useful in this low power range, the embodiment disclosed could function at power levels of more than 100 watts.

The dipole tubes 56 may be thin-walled copper tubing, though other conductive materials may be used. In the illustrative embodiment discussed above, the 2400 MHz to 2500 MHz range, the tubes are preferably from ⅜" to ⅝" in diameter. The diameter of the tubes is relatively large compared to their length, so as to make the dipole antenna segments "fat." As is well known, dipole antennas may be comprised of solid wire. However, a relatively large diameter compared to the length increases the bandwidth of the antennas, and the tubular configuration provides the practical advantage of allowing drive lines and other components to be contained inside the array.

The dipole tubes 56 are disposed colinearly, or in other words, the tubes share a central axis. However, as is clear from the drawings, they have the same diameter, and are oriented end-to-end, not one inside the other. They may be connected to the gap spacers and dipole spacers 54 by adhesive, cement, or other suitable means. The elongate array is then attached to a base 60, which includes a baseplate 62, and may have a cover 64 for covering and protecting a power divider 66.

The power divider 66 is configured for dividing and transmitting an in-phase signal from the transmission line 68 in parallel to each of the dipole segments 52. The baseplate 62 is a substantially rigid plate of conductive material, such as aluminum, stainless steel, or other suitable material, and is electrically grounded. The antenna may be provided with a bracket 70 or other hardware for attaching to a pole 72 or other suitable support.

Figure 3A:
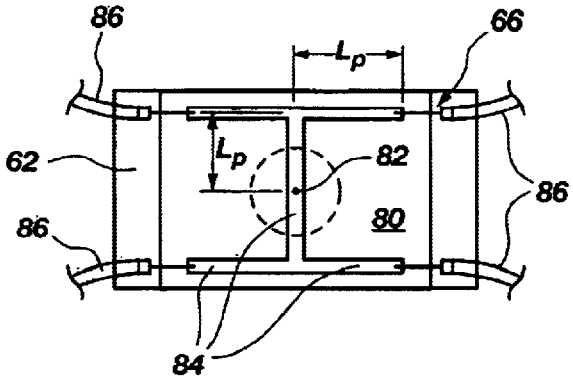
FIG. 3A is a plan view of a rectangularly shaped power divider configured for use with the antenna of FIG. 1.
Figure 3B:
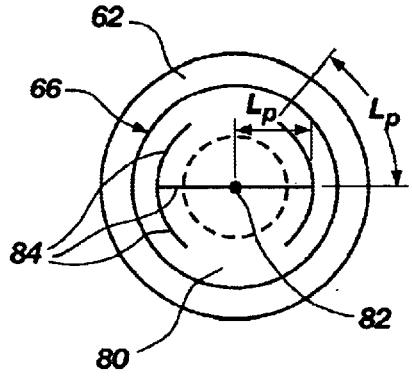
FIG. 3B is a plan view of a circularly shaped power divider configured for use with the antenna of FIG. 1.

Viewing FIG. 3A and FIG. 3B in combination with FIG. 2, the power divider 66 may comprise a Wilkinson divider, which includes a substrate 80, such as conventional printed circuit board material, with an input connection 82 and a plurality of conductive pathways 84 radiating therefrom. The input connection receives an input signal from the transmission line, and this signal is transmitted through each of the conductive pathways, which each correspond to one of the plurality of dipole antennas. The conductive pathways are comprised of segments having effective lengths $L_p$ equal to about one fourth the signal wavelength (i.e. $L_p=\lambda_0/4$), so as to reduce reflections, and to separate the dipole segments with respect to the driving signal, yet allow all segments to be connected to one signal source. The total effective distance to the end of each conductive path is $2L_p$, which is therefore equal to about one half the signal wavelength.

As used herein, the terms "effective length" "effective physical length" and "effective distance" mean the apparent electrical length or distance, respectively, which may or may not be the same as the actual physical distance or length. Such a length or distance may differ from the physical dimension of a component due to the electrical properties of the substance(s) involved. For example, the actual physical length of the segments of the conductive pathways varies slightly from the effective length $L_p$ as a function of the dielectric constant of the divider substrate material. Specifically, the wavelength of the signal in the conductive pathways 84, designated $\lambda_r$ (in inches), is equal to the inverse of the signal frequency $F_0$ (in MHz) times the square root of the dielectric constant $\epsilon_r$ of the material of the conductive pathways (i.e., in inches, $\lambda_r=11808/\{(\epsilon_r)^{1/2}F_0\}$) Thus, the physical length L of the conductive pathways is one fourth of $\lambda_r$ (i.e. $L=\lambda_r/4$).

Connected to the distal ends of the conductive pathways are a plurality of drive lines 86, each connected to one of the plurality of dipole segments. These drive lines may comprise coaxial cable, in which the core wire is connected to the end of the respective conductive pathway, and the coaxial shielding is electrically connected (i.e soldered) to the baseplate 62, which is electrically grounded. The drive lines 86 have an effective physical length $L_0$ equal to a multiple of one half of the selected signal wavelength (i.e. $L_0=n(\lambda_0/2)$), so as to reduce reflected signals, and to cause each of the dipole segments to be in phase with the others. As noted above, however, the actual physical length of the drive lines may vary somewhat from the effective length as a function of the dielectric constant of the drive lines. Specifically, the wavelength of the signal in the coaxial drive line $\lambda_c$, is equal to the inverse of the signal frequency, $F_0$ times the square root of the dielectric constant $\epsilon_c$ of the drive lines (i.e., in inches, $\lambda_c=11.81/\{(\epsilon_c)^{1/2}F_0\}$)) Thus, the effective length $L_0$ of the drive lines is equal to the actual length $l_0$ of the drive lines, plus or minus the signal wavelength in the coaxial drive lines, $\lambda_c$ (i.e. $L_0=l_0\pm\lambda_c$).

Viewing FIG. 2, the dipole spacers 54 and gap spacers 58 have central apertures 90 and 92, respectively, to allow the drive lines 86 to extend therethrough from the power divider 66 to each respective dipole 52. When a given drive line reaches its respective dipole, the core wire 94 is electrically connected to one of the dipole tubes, and the shielding 96 (which is electrically grounded through connection to the baseplate 62) is electrically connected to the other tube. These connections may be facilitated by a small hole 98 extending through each dipole tube near the attachment of the gap spacer 58. Each of the dipoles are connected in the same manner, similarly oriented in polarity, such that the dipoles are electrically connected in parallel. That is, considering the embodiment of FIG. 2, the core wire of each drive line is connected to the upper tube of one of the dipole antennas, and the shielding of the same drive line is connected to the lower tube of the dipole pair. It will be apparent that "upper" and "lower" as used here are completely arbitrary, and could be reversed without changing the performance of the antenna.

Those skilled in the art will recognize that it is desirable that each of the dipole antennas 52 have a characteristic impedance which matches the impedance of the transmission line 68. A typical one-half wavelength dipole has a characteristic impedance of about 73 ohms. In one embodiment of the present invention, to match a 50 ohm input signal, the dipole segments 52 each have a length $L_d$ selected to give the antenna a characteristic impedance of 50 ohms. Theoretically, this length should be about one half the wavelength. In practice, in this embodiment, the length $L_d$ is about 0.435 times the broadcast signal wavelength (i.e. $L_d=0.435\lambda_0$).

The matching network divider 66, which drives the dipole segments in parallel and in phase, in combination with the physical dimensions and spacing of the dipole segments, provides a directional antenna which provides high directivity in a plane perpendicular to the axis of the dipole array, and which is balanced omni-directionally. The parallel configuration and large diameter dipole segments creates a reliable, steady, low impedance drive, with wideband performance. Each dipole acts as though it were its own independent unit, but the array causes the entire antenna to function as a single unit, producing the desired wide, flat broadcast pattern. The antenna may be used, for example, to provide local wireless interconnection of computer terminals to a local area network, or LAN. A single antenna may be vertically oriented and centrally located on a particular floor of an office building, for example, and connected by wire to the LAN computer system. Advantageously, the broad flat broadcast pattern sends signals to all computer users on that floor, thus allowing local wireless connection to the network.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An antenna for broadcasting and receiving a signal of a selected wavelength, comprising:

a) a plurality of elongate dipole antennas, each comprising first and second collinear tubes of electrically conductive material having opposing ends and being oriented end-to-end in a linear array with a linear spacing between opposing ends of adjacent dipole antennas;

b) a gap spacer of dielectric material disposed between the first and second collinear tubes;

c) a power divider configured for dividing and transmitting an in-phase signal in parallel through a transmission line to each of the dipole antennas; and d) wherein the linear spacing of the dipole antennas in the array is selected such that the in-phase signals of the dipole antennas interfere with each other so as to focus that portion of the signal which propagates substantially perpendicularly to the linear array, and to diminish other portions of the signal.

2. An antenna in accordance with claim 1, wherein each of the plurality of dipole antennas have a characteristic impedance which matches an impedance of the transmission line.

3. An antenna in accordance with claim 2, wherein each of the dipoles have a length selected to have a characteristic impedance of 50 ohms.

4. An antenna in accordance with claim 3, wherein each of the dipoles have an effective length of about 0.435 times the selected wavelength.

5. An antenna in accordance with claim 1, wherein the plurality of dipole antennas are interconnected by a plurality of dipole spacers.

6. An antenna in accordance with claim 5, wherein the dipole spacers comprise a dielectric material selected from the group consisting of Delrin, ABS, and styrene.

7. An antenna in accordance with claim 5, wherein the dipole spacers separate the ends of adjacent dipole antennas by an effective distance equal to about one sixth of the selected wavelength.

8. An antenna in accordance with claim 5, wherein the effective distance from a center of one of the plurality of dipole antennas to a center of an adjacent dipole antenna is approximately 0.6 times the selected wavelength.

9. An antenna in accordance with claim 1, wherein the first and second collinear tubes comprise segments of thin-walled copper tubing.

10. An antenna in accordance with claim 1, wherein the power divider comprises a plurality of drive lines interconnecting each of the plurality of dipole antennas to the power divider.

11. An antenna in accordance with claim 1, wherein the plurality of elongate dipole antennas comprises four dipole antennas.

12. An antenna in accordance with claim 1, further comprising a base, having:

a) a substantially rigid, conductive baseplate to which the linear array of dipole antennas are attached; and b) a dielectric material for carrying the power divider.

13. An antenna in accordance with claim 1, wherein the power divider further comprises a Wilkinson divider having:

a) an input connection for receiving a signal to be transmitted;

b) a plurality of conductive pathways interconnected to the input connection, each of the conductive pathways corresponding to one of the plurality of dipole antennas, and each conductive pathway having an effective length equal to about one half the selected wavelength.

14. An antenna in accordance with claim 13, further comprising a plurality of drive lines, each drive line connecting one of the plurality of dipole antennas to one of the conductive pathways of the power divider.

15. An antenna in accordance with claim 14, wherein each of the drive lines has an effective physical length equal to an integer times about one half of the selected wavelength.

16. An antenna for transmitting and receiving a signal of a selected wavelength, comprising:

a) a base;

b) a plurality of elongate dipole antennas having opposing ends and being oriented end-to-end in a linear array, the plurality of dipole antennas being interconnected by a plurality of dipole spacers, with a first of the plurality of dipole antennas being attached to a dipole spacer which is attached to the base, each of the dipole antennas further comprising:

first and second collinear tubes of electrically conductive material; and a gap spacer disposed between the first and second collinear tubes;

c) a Wilkinson divider associated with the base, having a plurality of conductive pathways with distal ends, and configured for receiving an input signal; and d) a plurality of drive lines, each drive line connecting one of the plurality of dipole antennas to the distal end of one of the conductive pathways of the Wilkinson divider, and each of the drive lines having an effective length equal to a multiple of about one half of the selected wavelength.

17. An antenna in accordance with claim 16, wherein:

a) the drive lines comprise a core wire and shielding; and the base further comprises:

b) a substantially rigid conductive baseplate to which the linear array of dipole antennas is attached; and c) a dielectric material for carrying the Wilkinson divider; and wherein:

d) the core wire of each drive line is connected at one end to the distal end of one of the conductive pathways of the Wilkinson divider; and e) the shielding of each of the drive lines is connected at said one end to the baseplate.

18. An antenna in accordance with claim 17, wherein a) the core wire of each drive line is connected at a second end to the first tube of one of the dipole antennas; and b) the shielding of each of the drive lines is connected at said second end to the second tube of said one of the dipole antennas.

19. An antenna in accordance with claim 17, wherein the conductive pathways have an effective length equal to about one half of the selected wavelength.

20. An antenna in accordance with claim 16, wherein the dipole spacers and the gap spacers comprise a dielectric material selected from the group consisting of Delrin, ABS, and styrene.

21. An antenna for broadcasting and receiving a signal of a selected wavelength, comprising:

a) a plurality of elongate dipole antennas comprising first and second collinear tubes of electrically conductive material having opposing ends and being oriented end-to-end in a linear array;

b) a gap spacer comprising dielectric material disposed between the first and second collinear tubes; and c) a power divider configured for receiving an input signal and dividing and transmitting the input signal in parallel to each of the dipole antennas.

22. An antenna for broadcasting a signal of a selected wavelength, comprising:

a) a plurality of elongate dipole antennas, each comprising first and second collinear tubes of electrically conductive material having a length and opposing ends, and being oriented end-to-end in a linear array with a linear spacing between adjacent dipole antennas;

b) a gap spacer of dielectric material disposed between the first and second collinear tubes;

c) a power divider configured for dividing and transmitting an in-phase signal in parallel to each of the dipole antennas; and d) wherein the linear spacing of the dipole antennas in the array is correlated with the length of the dipoles and the selected wavelength, such that signals of the dipole antennas interfere with each other when broadcast, so as to focus signals which propagate substantially perpendicularly to the linear array, and to diminish other signals.

* * * * *